US007196505B2

(12) United States Patent
Luo et al.

(10) Patent No.: US 7,196,505 B2
(45) Date of Patent: Mar. 27, 2007

(54) DEVICE AND METHOD FOR LOW-POWER FAST-RESPONSE VOLTAGE REGULATOR WITH IMPROVED POWER SUPPLY RANGE

(75) Inventors: Wenzhe Luo, Shanghai (CN); Paul Ouyang, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 67 days.

(21) Appl. No.: 11/061,197

(22) Filed: Feb. 17, 2005

(65) Prior Publication Data

US 2006/0139018 A1 Jun. 29, 2006

(30) Foreign Application Priority Data

Dec. 28, 2004 (CN) ..... 2004 1 0099391

(51) Int. Cl.
*G05F 1/40* (2006.01)

(52) U.S. Cl. ..... 323/282; 323/266; 307/264

(58) Field of Classification Search ..... 323/282–286, 323/313–316; 327/54–67, 530, 541–546; 307/264, 494

See application file for complete search history.

(56) References Cited

U.S. PATENT DOCUMENTS 4,642,482 A * 2/1987 Kasperkovitz et al. ..... 327/333
5,694,076 A * 12/1997 Ishibashi ..... 327/541

* cited by examiner

*Primary Examiner*—Rajnikant B. Patel
(74) *Attorney, Agent, or Firm*—Townsend and Townsend and Crew LLP

(57) ABSTRACT

An apparatus and method for regulating voltage levels. The apparatus includes a first transistor and a second transistor coupled to the first transistor. The first transistor is configured to receive a reference voltage, and the second transistor is configured to receive a feedback voltage and generate a first voltage. The first voltage is associated with a difference between the reference voltage and the feedback voltage. Additionally, the apparatus includes a third transistor coupled to the second transistor and configured to receive the first voltage from the second transistor and generate an output voltage in response to at least the first voltage. Moreover, the apparatus includes a fourth transistor coupled to the third transistor and configured to receive the output voltage from the third transistor and generate the feedback voltage, and a first current generation system coupled to the fourth transistor through at least a node.

20 Claims, 2 Drawing Sheets

DEVICE AND METHOD FOR LOW-POWER FAST-RESPONSE VOLTAGE REGULATOR WITH IMPROVED POWER SUPPLY RANGE

CROSS-REFERENCE TO RELATED APPLICATIONS

This application claims priority to Chinese Patent Application No. 200410099391.3, filed Dec. 28, 2004, entitled "Device and Method for Low-Power Fast-Response Voltage Regulator with Improved Power Supply Range," by Inventors Wenzhe Luo and Ouyang, commonly assigned, incorporated by reference herein for all purposes.

The following three commonly-owned co-pending applications, including this one, are being filed concurrently and the other two are hereby incorporated by reference in their entirety for all puposes:

1. U.S. patent application Ser. No. 11/061,062 in the name of Wenzhe Luo, titled, "Device and Method for Voltage Regulator wit Low Standby Current,"

2. U.S. patent application Ser. No. 11/060,922, in the name of Weuzhe Luo, titled, "Device and Method for Voltage Regulator with Stable and Fast Response and Low Standby Current," and 3. U.S. patent application Ser. No. 11/061,197, in the name of Wenzhe Luo and Paul Ouyang, titled, "Device and Method for Low-Power Fast-Response Voltage Rtgulator with Improved Power Supply Range."

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention is directed to integrated circuits. More particularly, the invention provides a device and method for low-power fast-response voltage regulator with low standby current. Merely by way of example, the invention has been applied to a battery powered system. But it would be recognized that the invention has a much broader range of applicability.

The voltage regulator is widely used and integrated onto an integrated circuit chip. The integrated circuit chip may contain numerous transistors with shrinking size. The decrease in transistor size usually requires lowering the working voltage of the transistors. Hence the power supply voltage for the integrated circuit chip decreases with shrinking transistor size. The integrated circuit chip usually serves as a system component. The system also contains other subsystems whose working voltages may be higher than the working voltage of the transistors. Hence the power supply voltage for the system may be higher than that for the integrated circuit chip. For example, the system power supply equals 5 volts, and the chip power supply equals 3.3 volts. In another example, the system power supply equals 3.3 volts, and the chip power supply equals 1.8 volts.

To provide the chip power supply, the system power supply is usually converted by a voltage regulator. For example, the voltage regulator receives a 5-volt signal and generates a 3.3-volt signal. In another example, the voltage regulator receives a 3.3-volt signal and generates a 1.8-volt signal. FIG. 1 is a simplified diagram for conventional voltage regulator. A voltage regulator 100 includes a reference voltage generator 110, an operational amplifier 120, and a voltage divider 130. The voltage generator 110 generates a reference voltage $V_{ref}$ 112. The $V_{ref}$ 112 is received by the operational amplifier 120. The operational amplifier 120 also receives a system power supply $V_{system}$ 124 and generates an output voltage $V_{out}$ 122. The $V_{out}$ 122 is divided by the voltage 130 and the feedback voltage $V_{feedback}$ 132 is received by the operational amplifier. The $V_{out}$ 122 is used as the chip power supply. For example, the system power supply is 5 volts, and the desired chip power supply is 3.3 volts. If the $V_{ref}$ 112 equals 1.25 volts, the voltage divider 130 sets $V_{feedback}$ 132 to be equal to $(1.25/3.3)V_{out}$. In another example, the $V_{ref}$ 112 equals the desired chip power supply. Then the $V_{out}$ 122 is used directly as the $V_{feedback}$ 132 with the voltage divider 130 removed.

The voltage regulator usually provides the chip power supply when the system is in the active mode or the standby mode. With the voltage divider, the voltage regulator consumes important energy in the standby mode. The energy consumption in the standby mode limits the operation time of battery-powered devices. Furthermore, some battery-powered devices require low standby power consumption and cannot rely on the regulator that consumes significant power in the standby mode. On the other hand, without the voltage divider, the voltage regulator often cannot work with a continuous range of system power supply.

From the above, it is seen that an improved technique for voltage regulator is desired.

BRIEF SUMMARY OF THE INVENTION

The present invention is directed to integrated circuits. More particularly, the invention provides a device and method for low-power fast-response voltage regulator with low standby current. Merely by way of example, the invention has been applied to a battery powered system. But it would be recognized that the invention has a much broader range of applicability.

In a specific embodiment, the invention provides an apparatus for regulating voltage levels. The apparatus includes a first transistor and a second transistor coupled to the first transistor. The first transistor is configured to receive a reference voltage, and the second transistor is configured to receive a feedback voltage and generate a first voltage. The first voltage is associated with a difference between the reference voltage and the feedback voltage. Additionally, the apparatus includes a third transistor coupled to the second transistor and configured to receive the first voltage from the second transistor and generate an output voltage in response to at least the first voltage. Moreover, the apparatus includes a fourth transistor coupled to the third transistor and configured to receive the output voltage from the third transistor and generate the feedback voltage, and a first current generation system coupled to the fourth transistor through at least a node. The node is associated with the feedback voltage. The feedback voltage is substantially equal to a difference between the output voltage and a second voltage, and the second voltage is related to one or more characteristics of the fourth transistor and substantially constant.

According to another embodiment, an apparatus for regulating voltage levels includes a first transistor and a second transistor coupled to the first transistor. The first transistor is configured to receive a reference voltage, and the second transistor is configured to receive a feedback voltage and generate a first voltage. The first voltage is associated with a difference between the reference voltage and the feedback voltage. Additionally, the apparatus includes a third transistor coupled to the second transistor and configured to receive the first voltage from the second transistor and generate an output voltage in response to at least the first voltage. Moreover, the apparatus includes a fourth transistor coupled to the third transistor and configured to receive the output voltage from the third transistor and generate the feedback voltage, and a first current generation system coupled to the fourth transistor through at least a node. The node is associated with the feedback voltage. The feedback voltage is substantially equal to a difference between the output voltage and a second voltage, and the second voltage related to one or more characteristics of the fourth transistor and being substantially constant. The first transistor and the second transistor each are coupled to a current mirror, and the current mirror is coupled to a supply voltage. The third transistor and the fourth transistor each are coupled to the supply voltage. The output voltage is equal to the predetermined voltage, and the supply voltage is equal to or larger than the predetermined voltage.

According to yet another embodiment, an apparatus for regulating voltage levels includes a first transistor and a second transistor coupled to the first transistor. The first transistor is configured to receive a reference voltage, and the second transistor is configured to receive a feedback voltage and generate a first voltage. The first voltage is associated with a difference between the reference voltage and the feedback voltage. Additionally, the apparatus includes a third transistor coupled to the second transistor and configured to receive the first voltage from the second transistor and generate an output voltage in response to at least the first voltage. Moreover, the apparatus includes a fourth transistor coupled to the third transistor and configured to receive the output voltage from the third transistor and generate the feedback voltage, and a first current generation system coupled to the fourth transistor through at least a node. The node is associated with the feedback voltage. The feedback voltage is substantially equal to a difference between the output voltage and a second voltage, and the second voltage is related to one or more characteristics of the fourth transistor and substantially constant. The first transistor and the second transistor each are coupled to a load, and the load is coupled to a supply voltage.

Many benefits are achieved by way of the present invention over conventional techniques. Some embodiments of the present invention significantly reduce the power consumption of the voltage regulator in the standby mode. Certain embodiments of the present invention significantly improve the frequency response of the voltage regulator. Some embodiments of the present invention expand range of the supply voltage. For example, the voltage regulator can operate with a supply voltage equal to or larger than the desired output voltage. Depending upon the embodiment, one or more of these benefits may be achieved. These and other benefits will be described in more throughout the present specification and more particularly below.

Variousadditional objects, features and advantages of the present invention can be more fully appreciated with reference to the detailed description and accompanying drawings that follow.

DETAILED DESCRIPTION OF THE INVENTION

The present invention is directed to integrated circuits. More particularly, the invention provides a device and method for voltage regulator with low standby current. Merely by way of example, the invention has been applied to a battery powered system. But it would be recognized that the invention has a much broader range of applicability.

Figure 1:
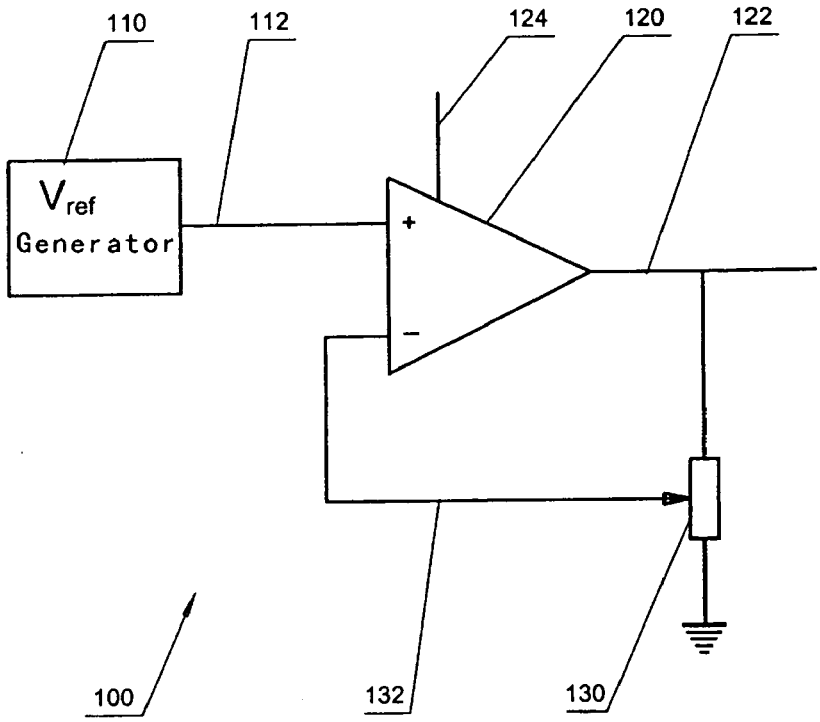
FIG. 1 is a simplified diagram for conventional voltage regulator.
Figure 2:
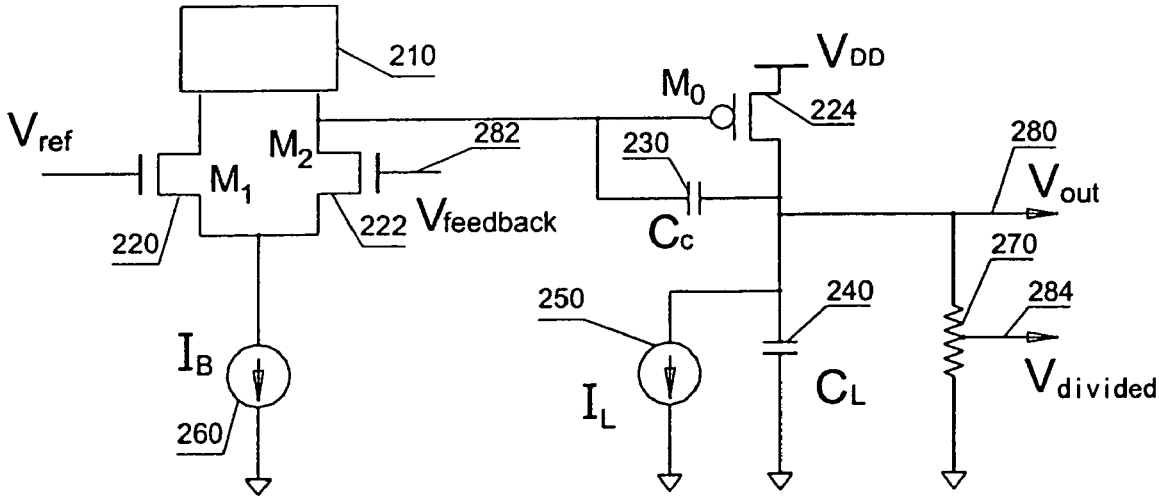
FIG. 2 is a simplified conventional voltage regulator.

FIG. 2 is a simplified conventional voltage regulator. The device 200 includes the following components:

1. Current Mirror 210;
2. Transistors 220, 222 and 224;
3. Compensation capacitor 230;
4. Load capacitor 240;
5. Current supplies 250 and 260;
6. Voltage divider 270.

The current mirror 210, the transistors 220 and 222, and the current supplier 260 form a first stage of a differential amplifier, and the transistors 220 and 222 forms a differential pair. The transistor 224, the compensation capacitor 230, the load capacitor 240, the current supplier 250, and the voltage divider 270 form an output stage of the differential amplifier. The voltage divider 270 is optional. If the voltage divider 270 is not used, a $V_{out}$ 280 serves as a $V_{feedback}$ 282 and follows a $V_{ref}$ 284. The $V_{ref}$ 284 may be provided by a voltage generator. In contrast, if the voltage divider 270 is used, a $V_{divided}$ 284 serves as the $V_{feedback}$ 282 and equals $V_{out}$ divided by a constant K. K is larger than 1.

For the voltage regulator 200, $V_{ref}$ is often required to be less than $V_{DD}$ minus $V_{sat}$ for the current mirror 210. $V_{DD}$ is the supply voltage for the current mirror 210. This requirement often enables the transistor 222 to remain in the active region. Hence the voltage regulator 200 is usually used for $V_{DD}$ larger than $V_{ref}$ plus about 1000 mV. Without the voltage regulator 270, $V_{DD}$ is often required to be larger than the desired $V_{outdesired}$ plus about 1000 mV. In contrast, with the voltage regulator 270, $V_{DD}$ is often required to be larger than ($V_{outdesired}$/K+1000 mV). As an example, $V_{DD}$ is larger than or equal to $V_{outdesired}$. Hence the voltage regulator 270 can expand the range of $V_{DD}$ for a given $V_{outdesired}$.

On the other hand, the voltage divider 270 can raise the static current and limit the frequency response of the voltage regulator 200. Specifically, the voltage divider 270 generates a pole at $V_{divided}$, which can slow the frequency response of the feedback loop. To limit the speed reduction, the impedance of the voltage divider 270 cannot be made too large. Hence the static current through the voltage divider 270 often cannot be further reduced.

In summary, without the voltage divider 270, the voltage regulator 200 carries less static current and provide faster frequency response, but often can operate with only a narrow range of $V_{DD}$. In contrast, with the voltage divider 270, the voltage regulator 200 often can with operate with a wider range of $V_{DD}$, but carries higher static current and provides slower frequency response.

Figure 3:
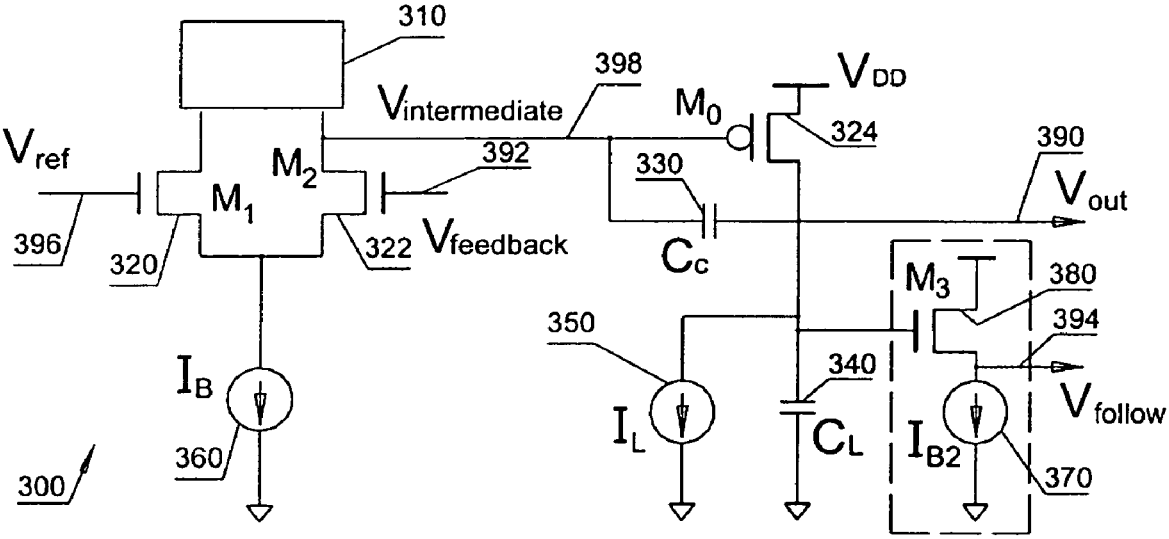
FIG. 3 is a simplified voltage regulator according to an embodiment of the present invention.

FIG. 3 is a simplified voltage regulator according to an embodiment of the present invention. The device 300 includes the following components:

1. Current Mirror 310;
2. Transistors 320, 322, 324, and 380;
3. Compensation capacitor 330;
4. Load capacitor 340;
5. Current supplies 350, 360, and 370.

The above electronic devices provide components for a voltage regulator according to an embodiment of the present invention. Other alternatives can also be provided where certain devices are added, one or more devices are removed, or one or more devices are arranged with different connections without departing from the scope of the claims herein. For example, the current supply 360 is removed and the transistors 320 and 322 are directly coupled to the ground level. As another example, a voltage generator is added to provide $V_{ref}$ to the transistor 320. In yet another example, the current mirror 310 is replaced by a load. In one embodiment, the load includes a current mirror.

The current mirror 310 couples the transistors 320 and 322 with a voltage source $V_{DD}$. For example, the voltage source $V_{DD}$ is the same as the power supply to the system of which the voltage regulator 300 is a component. The voltage source $V_{DD}$ may range from 1.8 V to 5 V. As an example, the current mirror 310, the transistors 320 and 322, and the current supply 360 form a first stage of an operational amplifier, and the transistors 320 and 322 serve as a differential pair. For example, the transistors 320 and 322 are NMOS transistors.

The transistors 320 and 322 receive the reference voltage $V_{ref}$ 396 and the feedback voltage $V_{feedback}$ 392. For example, the $V_{ref}$ 396 ranges from 1 V to 3.3 V. If the $V_{feedback}$ 392 is different from the $V_{ref}$ 396, the first stage of the operational amplifier generates a change in the intermediate voltage $V_{intermediate}$ 398. Additionally, the current supply 360 may range from 100 nA to 1 μA.

The $V_{intermediate}$ 398 is received by the transistor 324. As an example, the transistors 324 and 380, the compensation capacitor 330, the load capacitor 340, and the current suppliers 350 and 370 form parts of an output stage of the differential amplifier. The transistors 324 and 380 are coupled to a voltage source. For example, the voltage source is the same as $V_{DD}$. In another example, the transistor 324 is an NMOS transistor, and the transistor 380 is a PMOS transistor. The transistor 324 generates an output voltage $V_{out}$ 390 for the voltage regulator 300.

The $V_{out}$ 390 is received by the transistor 380. In one embodiment, the transistor 380 and the current supply 370 form a source follower, which outputs a follower voltage $V_{follower}$ 394. The $V_{follower}$ 394 is equal to ($V_{out}-V_T-V_{dsat}$) and used as the $V_{feedback}$ 392 for comparison with the $V_{ref}$ 396. $V_T$ and $V_{dsat}$ are the threshold voltage and the saturation voltage of the transistor 380 respectively. For example, $V_T$ ranges from 0.3 V to 0.8 V, and $V_{dsat}$ ranges from 50 mV to 500 mV. As another example, the current supply 370 ranges from 100 nA to 20 μA.

In one embodiment, for the voltage regulator 300, $V_{ref}$ should be less than $V_{DD}$ minus the saturation voltage $V_{satmirror}$ of the current mirror 310 in order to keep the transistor 322 in the active region. In other words, $$V_{DD}>V_{ref}+V_{satmirror} \quad \text{(Equation 1)}$$

where $V_{ref}$ equals the desired $V_{feedback}$, which is the same as the desired $V_{follower}$. For example, $V_{follower}$ is equal to the desired output voltage $V_{outdesired}$ minus ($V_T+V_{sat}$). Hence, $$V_{DD}>V_{outdesired}-(V_T+V_{dsat}-V_{satmirror}) \quad \text{(Equation 2)}$$

In one embodiment, $V_T+V_{dsat}-V_{satmirror}$ is larger than or equal to zero. The voltage regulator 300 can operate with $V_{DD}$ larger than or equal to $V_{outdesired}$.

As shown in FIG. 3, a conventional voltage divider has been replaced by the source follower, which can significantly reduce the static current. For the conventional voltage divider, the divider resistance is often set low in order to increase the small-signal pole of the voltage divider. The small divider resistance can cause a large DC current flow. In contrast, for the source follower, the small-signal pole can be increased by making the transistor 380 large. The current supply 370 remains small because of the small impedance at the source node of the transistor 370. Increasing the small-signal pole significantly improves the frequency response of the feedback loop.

The present invention has various advantages. Some embodiments of the present invention significantly reduce the power consumption of the voltage regulator in the standby mode. Certain embodiments of the present invention significantly improve the frequency response of the voltage regulator. Some embodiments of the present invention expand range of the supply voltage. For example, the voltage regulator can operate with a supply voltage equal to or larger than the desired output voltage.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. An apparatus for regulating voltage levels, the apparatus comprising:

a first transistor and a second transistor coupled to the first transistor, the first transistor configured to receive a reference voltage, the second transistor configured to receive a feedback voltage and generate a first voltage, the first voltage being associated with a difference between the reference voltage and the feedback voltage;

a third transistor coupled to the second transistor and configured to receive the first voltage from the second transistor and generate an output voltage in response to at least the first voltage;

a fourth transistor coupled to the third transistor and configured to receive the output voltage from the third transistor and generate the feedback voltage;

a first current generation system coupled to the fourth transistor through at least a node, the node being associated with the feedback voltage; and a compensation capacitor coupled to a gate of the third transistor and a source or a drain of the third transistor;

wherein the feedback voltage is substantially equal to a difference between the output voltage and a second voltage, the second voltage related to one or more characteristics of the fourth transistor and being substantially constant.

2. The apparatus of claim 1 wherein the second voltage is substantially equal to a sum of a threshold voltage and a saturation voltage, the threshold voltage and the saturation voltage each associated with the fourth transistor.

3. The apparatus of claim 2 wherein the threshold voltage ranges from 0.3 V to 0.8 V.

4. The apparatus of claim 3 wherein the saturation voltage ranges from 50 mV to 500 mV.

5. The apparatus of claim 1 wherein the first current generation system outputs a current, the current being substantially constant and ranging from 100 nA to 20 μA.

6. The apparatus of claim 1 wherein the first transistor and the second transistor each are coupled to a current mirror, the current mirror is coupled to a supply voltage.

7. The apparatus of claim 6 wherein the third transistor and the fourth transistor each are coupled to the supply voltage.

8. The apparatus of claim 6 wherein the reference voltage is substantially equal to a difference between a predetermined voltage and the second voltage.

9. An apparatus for regulating voltage levels, the apparatus comprising:

a first transistor and a second transistor coupled to the first transistor, the first transistor configured to receive a reference voltage, the second transistor configured to receive a feedback voltage and generate a first voltage, the first voltage being associated wit a difference between the reference voltage and the feedback voltage;

a third transistor coupled to the second transistor and configured to receive the first voltage from the second transistor and generate an output voltage in response to at least the first voltage;

a fourth transistor coupled to the third transistor and configured to receive the output voltage from the third transistor and generate the feedback voltage;

a first current generation system coupled to the fourth transistor through at least a node, the node being associated with the feedback voltage;

wherein the feedback voltage is substantially equal to a difference between the output voltage and a second voltage, the second voltage related to one or more characteristics of the fourth transistor and being substantially constant;

wherein the first transistor and the second transistor each are coupled to a current mirror, the current minor being coupled to a supply voltage;

wherein the reference voltage is substantially equal to a difference between a predetermined voltage and the second voltage;

wherein the output voltage is equal to the predetermined voltage, and the supply voltage is equal to or larger than the predetermined voltage.

10. The apparatus of claim 9 wherein the supply voltage is equal to the predetermined voltage.

11. An apparatus for regulating voltage levels, the apparatus comprising:

a first transistor and a second transistor coupled to the first transistor, the first transistor configured to receive a reference voltage, the second transistor configured to receive a feedback voltage and generate a first voltage, the first voltage being associated with a difference between the reference voltage and the feedback voltage;

a third transistor coupled to the second transistor and configured to receive the first voltage from the second transistor and generate an output voltage in response to at least the first voltage;

a fourth transistor coupled to the third transistor and configured to receive the output voltage from the third transistor and generate the feedback voltage;

a first current generation system coupled to the fourth transistor through at least a node, the node being associated with the feedback voltage;

a compensation capacitor coupled to a gate of the third transistor and a source or a drain of the third transistor;

wherein the feedback voltage is substantially equal to a difference between the output voltage and a second voltage, the second voltage related to one or more characteristics of the fourth transistor and being substantially constant.

12. The apparatus of claim 11, and further comprising a load capacitor coupled to at least the source or the drain of the third transistor.

13. The apparatus of claim 12, and further comprising a second current generation system coupled to at least the source or the drain of the third transistor.

14. The apparatus of claim 13, and further comprising a third current generation system coupled to at least the first transistor and the second transistor.

15. An apparatus for regulating voltage levels, the apparatus comprising:

a first transistor and a second transistor coupled to the first transistor, the first transistor configured to receive a reference voltage, the second transistor configured to receive a feedback voltage and generate a first voltage, the first voltage being associated with a difference between the reference voltage and the feedback voltage;

a third transistor coupled to the second transistor and configured to receive the first voltage from the second transistor and generate an output voltage in response to at least the first voltage;

a fourth transistor coupled to the third transistor and configured to receive the output voltage from the third transistor and generate the feedback voltage;

a first current generation system coupled to the fourth transistor through at least a node, the node being associated with the feedback voltage; and a compensation capacitor coupled to a gate of the third transistor and a source or a drain of the third transistor;

wherein:

the feedback voltage is substantially equal to a difference between the output voltage and a second voltage, the second voltage related to one or more characteristics of the fourth transistor and being substantially constant;

the first transistor and the second transistor each are coupled to a current mirror, the current mirror coupled to a supply voltage;

the third transistor and the fourth transistor each are coupled to the supply voltage;

the output voltage is equal to the predetermined voltage, and the supply voltage is equal to or larger than the predetermined voltage.

16. The apparatus of claim 15 wherein the supply voltage is equal to the predetermined voltage.

17. An apparatus for regulating voltage levels, the apparatus comprising:

a first transistor and a second transistor coupled to the first transistor, the first transistor configured to receive a reference voltage, the second transistor configured to receive a feedback voltage and generate a first voltage, the first voltage being associated with a difference between the reference voltage and the feedback voltage;

a third transistor coupled to the second transistor and configured to receive the first voltage from the second transistor and generate an output voltage in response to at least the first voltage;

a fourth transistor coupled to the third transistor and configured to receive the output voltage from the third transistor and generate the feedback voltage;

a first current generation system coupled to the fourth transistor through at least a node, the node being associated with the feedback voltage;

wherein:

the feedback voltage is substantially equal to a difference between the output voltage and a second voltage, the second voltage related to one or more characteristics of the fourth transistor and being substantially constant;

the first transistor and the second transistor each are coupled to a current mirror, the current mirror coupled to a supply voltage;

the third transistor and the fourth transistor each are coupled to the supply voltage;

the output voltage is equal to the predetermined voltage, and the supply voltage is equal to or larger than the predetermined voltage; and wherein the second voltage is substantially equal to a sum of a threshold voltage and a saturation voltage, the threshold voltage and the saturation voltage each associated wit the fourth transistor.

18. An apparatus for regulating voltage levels, the apparatus comprising:

a first transistor and a second transistor coupled to the first transistor, the first transistor configured to receive a reference voltage, the second transistor configured to receive a feedback voltage and generate a first voltage, the first voltage being associated with a difference between the reference voltage and the feedback voltage;

a third transistor coupled to the second transistor and configured to receive the first voltage from the second transistor and generate an output voltage in response to at least the first voltage;

a fourth transistor coupled to the third transistor and configured to receive the output voltage from the third transistor and generate the feedback voltage;

a first current generation system coupled to the fourth transistor through at least a node, the node being associated with the feedback voltage;

wherein:

the feedback voltage is substantially equal to a difference between the output voltage and a second voltage, the second voltage related to one or more characteristics of the fourth transistor and being substantially constant;

the first transistor and the second transistor each are coupled to a load, the load coupled to a supply voltage.

19. The apparatus of claim 18 wherein the second voltage ranges from 0.35 V to 1.3 V.

20. The apparatus of claim 19 wherein the first current generation system outputs a current, the current being substantially constant and ranging from 1 μA to 20 μA.

* * * * *